US007547185B2

(12) United States Patent
Giesler et al.

(10) Patent No.: US 7,547,185 B2
(45) Date of Patent: Jun. 16, 2009

(54) OUTPUT SHAFT AIR/OIL SEPARATOR TO REDUNDANTLY PROTECT AGAINST OUTPUT SHAFT O-RING LEAKAGE

(75) Inventors: William L. Giesler, Phoenix, AZ (US); Brent L. Bristol, Phoenix, AZ (US); Michael J. Burns, Phoenix, AZ (US); Tina Marie Hynes, Phoenix, AZ (US)

(73) Assignee: Honeywell International Inc., Morristown, NJ (US)

( * ) Notice: Subject to any disclaimer, the term of this patent is extended or adjusted under 35 U.S.C. 154(b) by 522 days.

(21) Appl. No.: 11/207,263

(22) Filed: Aug. 19, 2005

(65) Prior Publication Data

US 2007/0292263 A1 Dec. 20, 2007

(51) Int. Cl.
*F01D 25/18* (2006.01)
*F01D 15/12* (2006.01)

(52) U.S. Cl. ..... 415/112; 415/111; 415/113; 415/122.1; 415/123; 415/175; 415/229; 415/230; 55/385.1; 277/424; 384/473; 384/474; 192/113.32; 60/788; 184/6.23; 184/11.1; 184/11.2; 184/13.1

(58) Field of Classification Search ..... 415/109, 415/111–113, 122.1, 123, 175, 229–231; 55/385.1; 277/423, 424; 384/473, 474; 60/39.183, 60/788; 192/113.32, 113.5; 184/6.23, 11.1, 184/11.2, 13.1
See application file for complete search history.

(56) References Cited

U.S. PATENT DOCUMENTS 1,676,894 A * 7/1928 Frank ..... 384/474
1,840,127 A * 1/1932 Penney ..... 415/112
2,272,757 A * 2/1942 Teker ..... 384/473
4,009,972 A * 3/1977 Sarle ..... 415/112
4,157,834 A 6/1979 Burdette
4,576,001 A 3/1986 Smith
4,824,327 A 4/1989 Titterton, III
4,871,296 A 10/1989 Laessle et al.
4,928,978 A 5/1990 Shaffer et al.
4,958,941 A * 9/1990 Imanari ..... 384/474
5,224,713 A 7/1993 Pope
5,257,903 A 11/1993 Allmon et al.
5,261,237 A 11/1993 Benson
5,267,433 A * 12/1993 Burch ..... 60/788
5,636,848 A 6/1997 Hager et al.
5,776,229 A 7/1998 Blanes et al.
6,099,243 A 8/2000 Fiore (Continued)

*Primary Examiner*—Christopher Verdier
(74) *Attorney, Agent, or Firm*—Ingrassia Fisher & Lorenz, P.C.

(57) ABSTRACT

An output shaft air/oil separator system comprises an outer housing, an oil passage, a spline shaft having a cavity formed therein that communicates with the oil passage, an output shaft disposed at least partially within the spline shaft cavity that has a first section spaced apart from an inner surface of the spline shaft to form a gap therebetween in communication with the spline shaft cavity and a second section contacting at least a portion of the spline shaft inner surface, a housing cavity defined by at least a portion of an outer surface of the spline shaft and the outer housing, an annular groove formed in the spline shaft communicating with the spline shaft cavity, and at least one port extending between the spline shaft inner and outer surfaces in communication with the annular groove and the housing cavity.

17 Claims, 6 Drawing Sheets

U.S. PATENT DOCUMENTS 6,398,833 B1 6/2002 Santerre et al.
6,585,483 B2 * 7/2003 Feest ..... 415/122.1
6,629,816 B2 10/2003 Langston et al.
6,681,579 B2 * 1/2004 Lane et al. ..... 60/788
6,858,056 B2 2/2005 Kwan
6,877,950 B2 4/2005 Liu
7,186,081 B2 * 3/2007 Giesler et al. ..... 415/229
7,367,427 B2 * 5/2008 Gaines et al. ..... 415/112
2002/0141862 A1 10/2002 McEwen
2002/0158418 A1 10/2002 Thiesemann et al.
2004/0012149 A1 1/2004 Laurello et al.

* cited by examiner

OUTPUT SHAFT AIR/OIL SEPARATOR TO REDUNDANTLY PROTECT AGAINST OUTPUT SHAFT O-RING LEAKAGE

TECHNICAL FIELD

The present invention relates to an air turbine starter and, more particularly, to a system for preventing leakage of oil through an output shaft of the air turbine starter.

BACKGROUND

Shafts are commonly used to rotationally support various rotatable components of a turbomachine. Generally, the turbomachine includes an internal component shaft to which a turbine wheel and/or compressor wheel may be mounted, and an output shaft that is configured to couple the turbomachine to an accessory, such as a gearbox. Both of the shafts extend at least partially through the turbomachine.

In many cases, the internal component shaft and output shaft rotate at different speeds during operation. To allow the two shafts to operate with one another, an overrunning clutch may be coupled therebetween. The clutch includes a bearing housing, an inner race, and a plurality of bearings disposed therebetween. Generally, the clutch is lubricated via oil that is circulated from a sump into the bearing housing.

In some turbomachine configurations, the output shaft extends through an end wall of the bearing housing. Generally, it is desirable to minimize or eliminate oil leakage along the rotating shaft and through the end wall of the bearing housing to confine circulatory oil flow to the interior of the bearing housing. In this regard, a wide variety of oil seal configurations have been proposed in efforts to overcome oil leakage problems. In one example, an annular groove has been formed in the rotatable shaft and an o-ring disposed therein. However, the high speed shaft rotation and other operating conditions in a typical turbomachine environment have generally precluded complete elimination of the oil leakage. In particular, high speed shaft rotation at high environmental temperatures tends to result in relatively rapid wear of seal structures, rapid compression set of elastomers and early onset of oil leakage.

Hence, there is a need for a system that minimizes oil leakage from the turbomachine. It is also desirable for the system to be operable during high speed shaft rotation. Moreover, it is desirable for the system to have an extended life.

BRIEF SUMMARY

The present invention provides an air turbine starter. The air turbine starter comprises an outer housing, an oil passage, a spline shaft, an output shaft, a housing cavity, an annular groove, and at least one port. The oil passage is disposed in the outer housing and has an outlet port. The spline shaft has a first end, a second end, an outer surface, and an inner surface defining a cavity extending between the first and second ends, the cavity in communication with the oil passage outlet port. The output shaft is disposed at least partially within the spline shaft cavity and has an outer surface including a first section and a second section, where the first section is spaced apart from the spline shaft inner surface to form a gap therebetween in communication with the spline shaft cavity, and the second section contacts at least a portion of the spline shaft inner surface. The housing cavity is defined by at least a portion of the spline shaft outer surface and the outer housing. The annular groove is formed in the spline shaft outer surface in communication with the spline shaft cavity. At least one port extends between the spline shaft inner and outer surfaces. The port has an inlet in communication with the annular groove and an outlet in communication with the housing cavity.

In another embodiment, and by way of example only, an output shaft air/oil separator system, comprises an outer housing, an oil passage disposed at least partially within the outer housing and having an outlet, a spline shaft, an annular oil cooled rotor component, a housing cavity, an annular groove, and two ports. The spline shaft has a first end, a second end, an outer surface, and an inner surface defining a cavity extending between the first and second ends. The cavity communicates with the oil passage outlet. The annular oil cooled rotor component is mounted to the spline shaft outer surface and has an inner surface, an outer surface, a first groove, a second groove, and a passage, where the first and second grooves are formed in the component inner surface, and the passage is formed between the component inner and outer surfaces in communication with the second groove. The housing cavity is defined by at least a portion of the annular oil cooled rotor component outer surface and the outer housing. The annular groove is formed in the spline shaft outer surface and in communication with the annular oil cooled rotor component first groove. The first port extends between the spline shaft inner and outer surfaces and has an inlet in communication with the annular groove and an outlet in communication with the annular oil cooled rotor component first groove. The second port extends between the spline shaft inner and outer surfaces and is disposed between the first port and spline shaft second end. The second port has an inlet and an outlet in communication with the second groove.

In still another embodiment, an air turbine starter is provided that includes an outer housing, an oil passage disposed in the outer housing and having an outlet port, a spline shaft, an output shaft, a bearing assembly, a bearing cavity, a housing cavity, an annular groove, a first port, and a second port. The spline shaft has a first end, a second end, an outer surface, and an inner surface defining a cavity extending between the first and second ends, and is in communication with the oil passage outlet port. The output shaft is disposed at least partially within the spline shaft cavity and has an outer surface including a first section and a second section, where the first section is spaced apart from the spline shaft inner surface to form a gap therebetween in communication with the spline shaft cavity, and the second section contacts at least a portion of the spline shaft inner surface. The bearing assembly is mounted to at least a portion of the spline shaft outer surface. The bearing cavity is defined by the bearing assembly and the spline shaft outer surface. The housing cavity is defined by at least a portion of the spline shaft outer surface and the outer housing. The annular groove is formed in the spline shaft outer surface in communication with the spline shaft cavity. The first port extends between the spline shaft inner and outer surfaces and has an inlet in communication with the annular groove and an outlet in communication with the housing cavity. The second port extends between the spline shaft inner and outer surfaces and has an inlet in communication with the spline shaft cavity and an outlet in communication with the bearing cavity.

Other independent features and advantages of the preferred system will become apparent from the following detailed description, taken in conjunction with the accompanying drawings which illustrate, by way of example, the principles of the invention.

DETAILED DESCRIPTION OF A PREFERRED EMBODIMENT

The following detailed description of the invention is merely exemplary in nature and is not intended to limit the invention or the application and uses of the invention. Although the invention is described here as being incorporated into an air turbine starter, it will be appreciated that the invention may be implemented into any other application, for example, on an accessory drive shaft, power take off location, for an auxiliary power unit, main propulsion engine, or a ground power unit, pump shafting, or any location where rotational power is being transmitted by an intermediate connecting shaft. Furthermore, there is no intention to be bound by any theory presented in the preceding background of the invention or the following detailed description of the invention.

Figure 1:
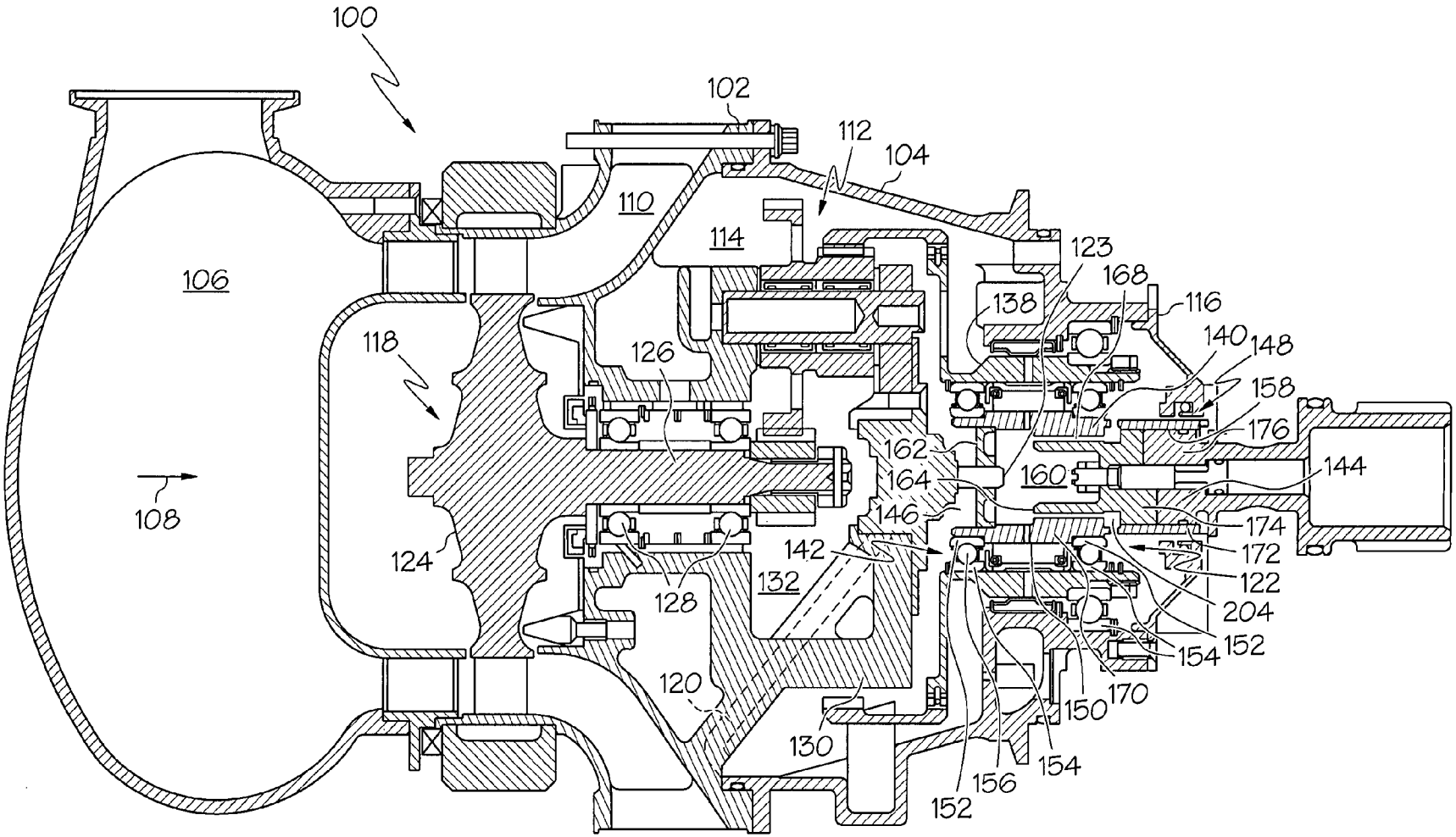
FIG. 1 is a cross-sectional view of an exemplary air turbine starter.

Turning now to FIG. 1, an air turbine starter ("ATS") 100 is depicted. The ATS 100 includes a first outer housing assembly 102 and a second outer housing assembly 104. The first outer housing assembly 102 is configured to define a flow path 106 extending from an inlet 108 to an outlet 110. The second outer housing assembly 104 is coupled at one end to the first outer housing assembly 102 and at least partially forms a housing cavity 114 therebetween. The housing cavity 114 is configured to contain various components of the ATS 100 therein. On an opposite end of the second outer housing assembly 104, a cover plate 116 is coupled thereto that encloses the housing cavity 114.

As briefly mentioned previously, various components are disposed within the housing cavity 114. For example, the housing cavity 114 includes at least a turbine section 118, a gear train 112, an oil source passage 120, and an overrunning clutch 122. The turbine section 118 includes a turbine wheel 124 having a rotatable shaft 126 extending therefrom that is journaled by bearings 128 to a portion of the first outer housing assembly 102. The shaft 126 extends partially into an inner housing 130 that defines a gear train cavity 132 within which a portion of the gear train 112 is disposed. The inner housing 130 also has the oil source passage 120 formed therein. The oil source passage 120 is configured to receive oil from a non-illustrated oil source and to deliver the oil through an output port 123 to the clutch 122.

The clutch 122 shown in FIG. 1 is a sprag type clutch, although other clutch mechanisms may alternatively be used. The clutch 122 includes a ring gear hub 138, a spline shaft 140, a bearing assembly 142, and an output shaft 144. The ring gear hub 138 is mounted between the inner housing 130 and the second outer housing assembly 104 and includes a space 146 therein.

The spline shaft 140 includes a first section 170 disposed within the ring gear hub space 146 and may include a second section 172 that extends partially outside of the ATS 100 via an opening 148 formed in the cover plate 116. The spline shaft 140 interfaces with the hub gear 138 via the bearing assembly 142. Specifically, the spline shaft 140 includes an outer surface 150 on which two spaced apart inner races 152 of the bearing assembly 142 are mounted. Two outer races 154 that correspond to the inner races 152 are mounted to the hub gear 138 and a plurality of bearing balls 156 is mounted between the inner and outer races 152, 154.

The spline shaft 140 also includes an inner surface 158 that defines a spline cavity 160 for receiving oil from the oil source passage 120 and through which the output shaft 144 partially extends. The spline cavity 160 is partially enclosed by an end 164 of the output shaft 144 and a cap 162. A first portion 174 of the output shaft 144 is preferably configured to be sufficiently spaced apart from the spline shaft inner surface 158 to provide a spline tooth radial gap 168 therebetween, while a second portion 176 of the output shaft 144 is configured to contact the spline shaft inner surface 158. The output shaft 144 also extends outside of the air turbine starter 100 for coupling to, for example, a starter pad on a gearbox of a gas turbine engine or other accessory.

Each component of the clutch 122 is preferably kept lubricated while the ATS 100 is in operation. In this regard, after the oil is received by the spline cavity 160, at least a portion travels into the spline tooth radial gap 168 and into an output shaft air/oil separator system 200, shown in FIG. 2. The air/oil separator system 200 catches the oil when the spline shaft 140 and output shaft 144 rotate to thereby distribute the oil to various components of the clutch 122. Additionally, the air/oil separator system 200 prevents the oil from exiting the ATS 100 through small gaps that may be present between the output shaft 144, spline shaft 140, and an o-ring 206, which will be described in further detail below.

Figure 2:
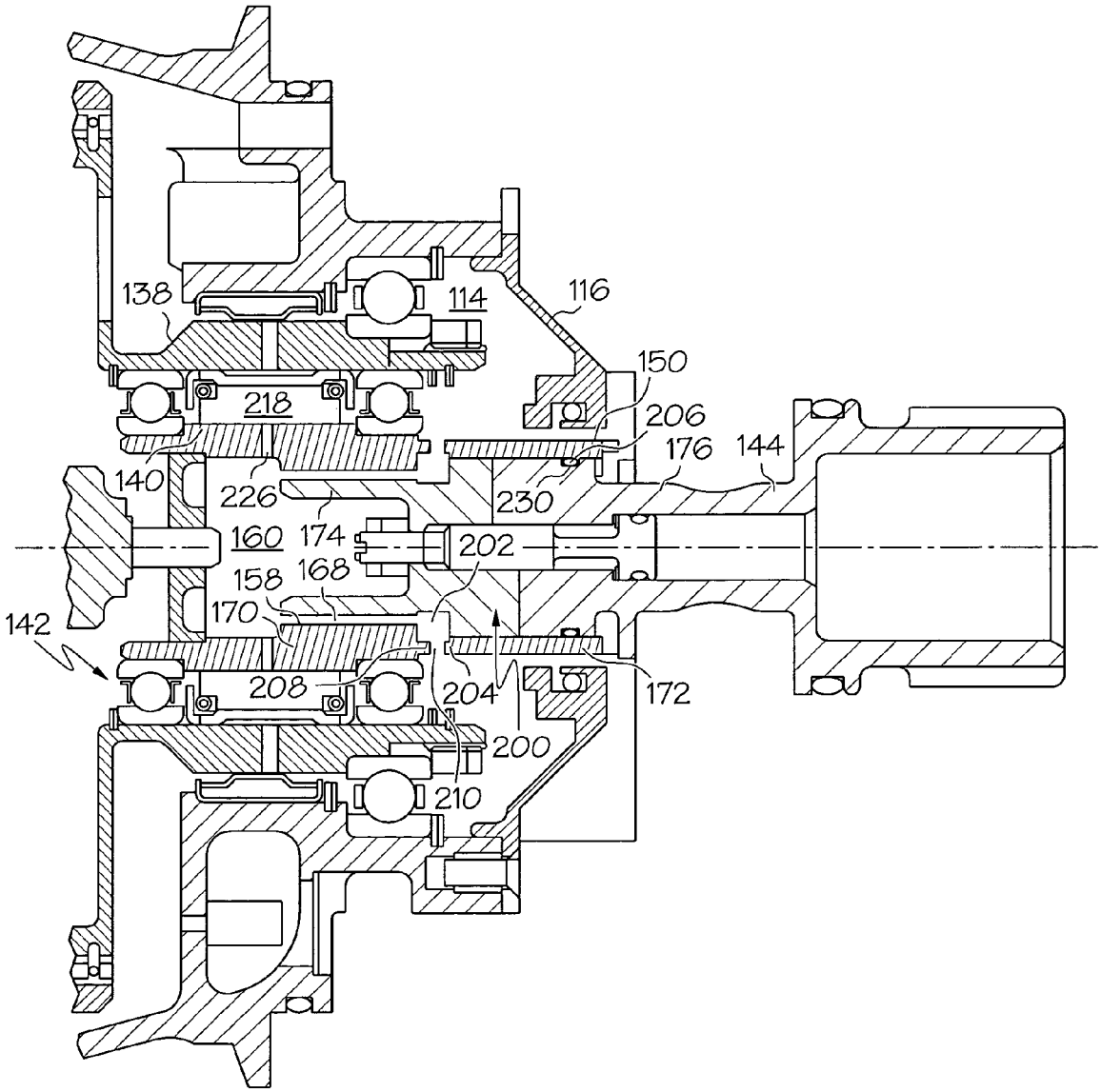
FIG. 2 is a close-up view of an exemplary output shaft air/oil separator system that may be implemented into the air turbine starter of FIG. 1.

The air/oil separator system 200 includes an annular oil collecting groove 202, at least one housing cavity port 204 that communicates with the annular groove 202, and o-ring 206 mounted to an outer surface of the output shaft 144. The annular groove 202 is formed on the inner surface 158 of the spline shaft 140 and is preferably located to receive oil as it travels over the output shaft first portion 174 and spline tooth radial gap 168 before it reaches the output shaft second portion 176. The annular groove 202 may have any one of numerous cross section shapes. For example, as depicted in FIG. 2, the annular groove 202 has a square cross section. In another example, shown in FIG. 3, the annular groove 202 has a V-shaped cross section. In still another example, the annular groove 202 has a semi-circular shape, as shown in FIG. 4.

Figure 3:
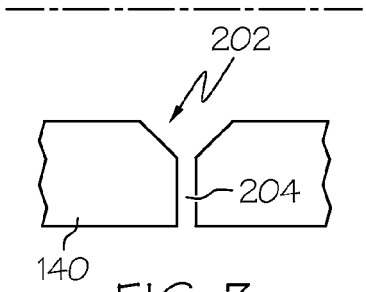
FIG. 3 is a cross-sectional view of an exemplary groove that may be implemented into the air/oil separator system of FIG. 2.
Figure 4:
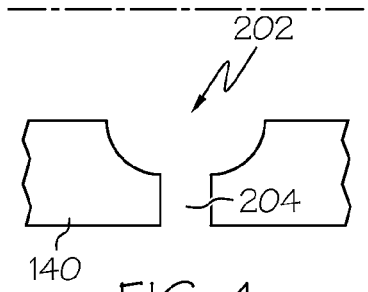
FIG. 4 is a cross-sectional view of another exemplary groove that may be implemented into the air/oil separator system of FIG. 2.
Figure 6:
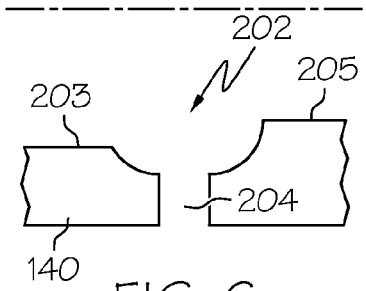
FIG. 6-11 are cross sectional-views of exemplary grooves that may be implemented into the oil separator system of FIG. 2.
Figure 7:
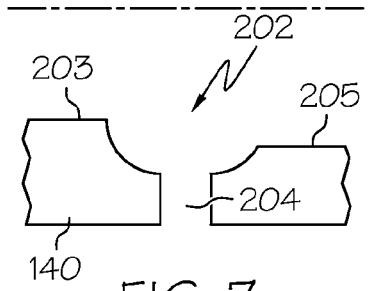
Figure 8:
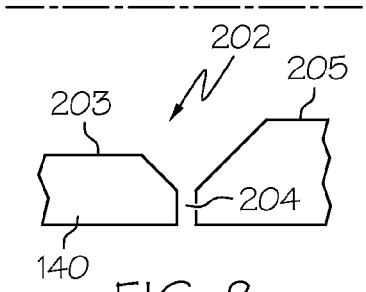
Figure 9:
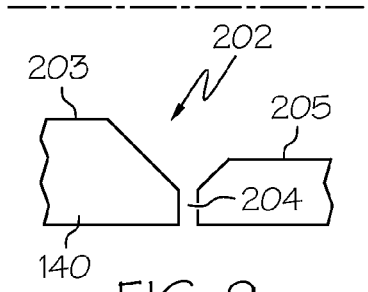
Figure 10:
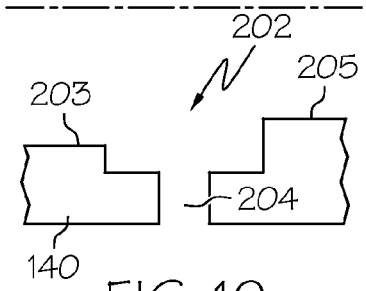
Figure 11:
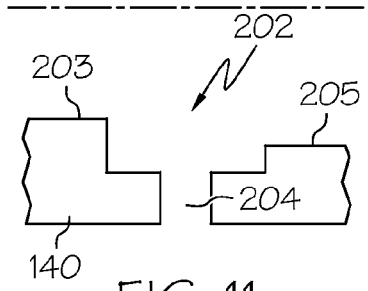
Figure 5:
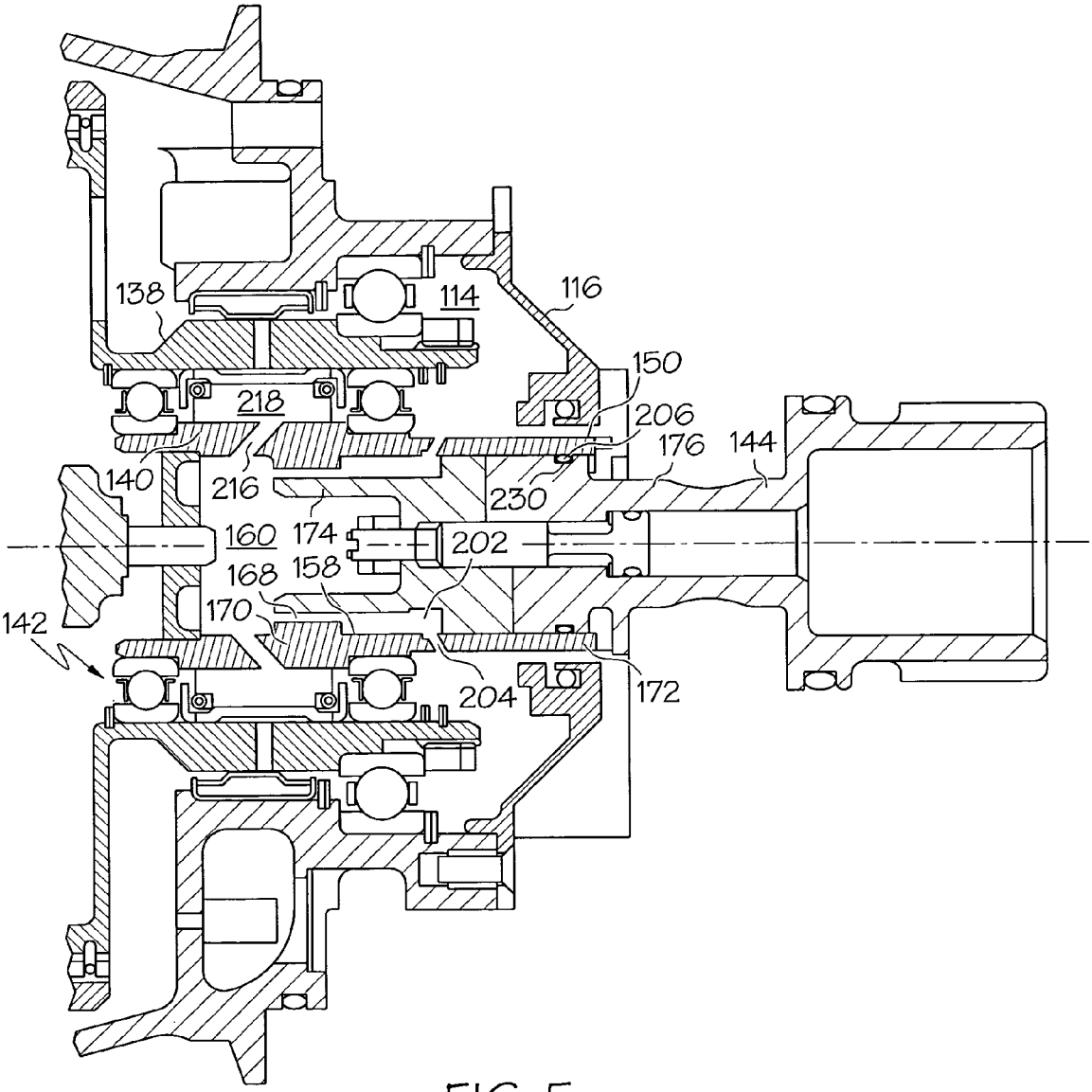
FIG. 5 is a cross-sectional view of still another exemplary output shaft air/oil separator system that may be implemented into the air turbine starter of FIG. 1.

Although the annular groove 202 is depicted in FIGS. 2-4 as having an axial length that is relatively small, in an alternate embodiment, shown in FIG. 5, the annular groove 202 extends axially away from the spline shaft second section 172 to thereby enlarge the gap 168 between the spline shaft 140 and the output shaft 144. In such case, the annular groove 202 may still have a semi-circular shape as shown in FIGS. 6 and 7, a V-shape, as shown in FIGS. 8 and 9, or a rectangular shape, as shown in FIGS. 10 and 11. As shown in FIGS. 6-11, the annular groove 202 may be stepped, having a first section 203 and a second section 205, each axially disposed on opposite sides of the housing cavity port 204. In one exemplary embodiment, the first section 203 has a diameter that is greater than the diameter of the second section 205, as illustrated in FIGS. 7, 9, and 11. In another exemplary embodiment, the first section 203 has a diameter that is smaller than the diameter of the second section 205, as illustrated in FIGS. 6, 8, and 10. It should be noted that while seal 206 is shown as an elastomeric o-ring many different seal configurations may be alternatively used. Suitable seal designs include but are not limited to plastic capped elastomer rings, square or quad cross section elastomer rings, piston rings made of carbon, steel or plastic, metal C or V rings, plastic C or V rings, metal spring energized plastic C or V rings.

Returning to FIG. 2, each housing cavity port 204 is formed in the spline shaft 140 and extends radially outward between an inlet 208 and an outlet 210. The port inlet 208 communicates with the annular groove 202. It will be appreciated that although each housing cavity port 204 is shown in FIG. 2 as being formed substantially perpendicular to at least one of the surfaces of the spline shaft 140, the ports 204 may alternatively be formed at an angle relative to at least one of the surfaces of the spline shaft 140 to thereby allow the port outlet 210 to communicate with the housing cavity 114, as shown in FIG. 5. Moreover, although two housing cavity ports 204 are shown in FIGS. 2 and 5, any other number of ports may alternatively be incorporated into the spline shaft 140.

In an alternative embodiment, additional ports are formed in the spline shaft 140 to provide additional passages through which the oil may travel to reach the clutch 122. In one exemplary embodiment, bearing cavity ports 226 are formed in the spline shaft 140 upstream from the housing cavity ports 204. The bearing cavity ports 226 extend between the spline cavity 160 and clutch 122 between the two inner and outer races 152, 154.

In another alternative embodiment, a second redundant system is implemented to further ensure that the oil does not leak out of the ATS 100. In this regard, an annular notch 230 is formed around an outer surface of the output shaft 144 and the o-ring 206 is disposed at least partially therein. Preferably, the annular notch 230 is configured such that the o-ring 206 may extend externally thereof to contact and form a seal with the spline shaft inner surface 158.

Figure 12:
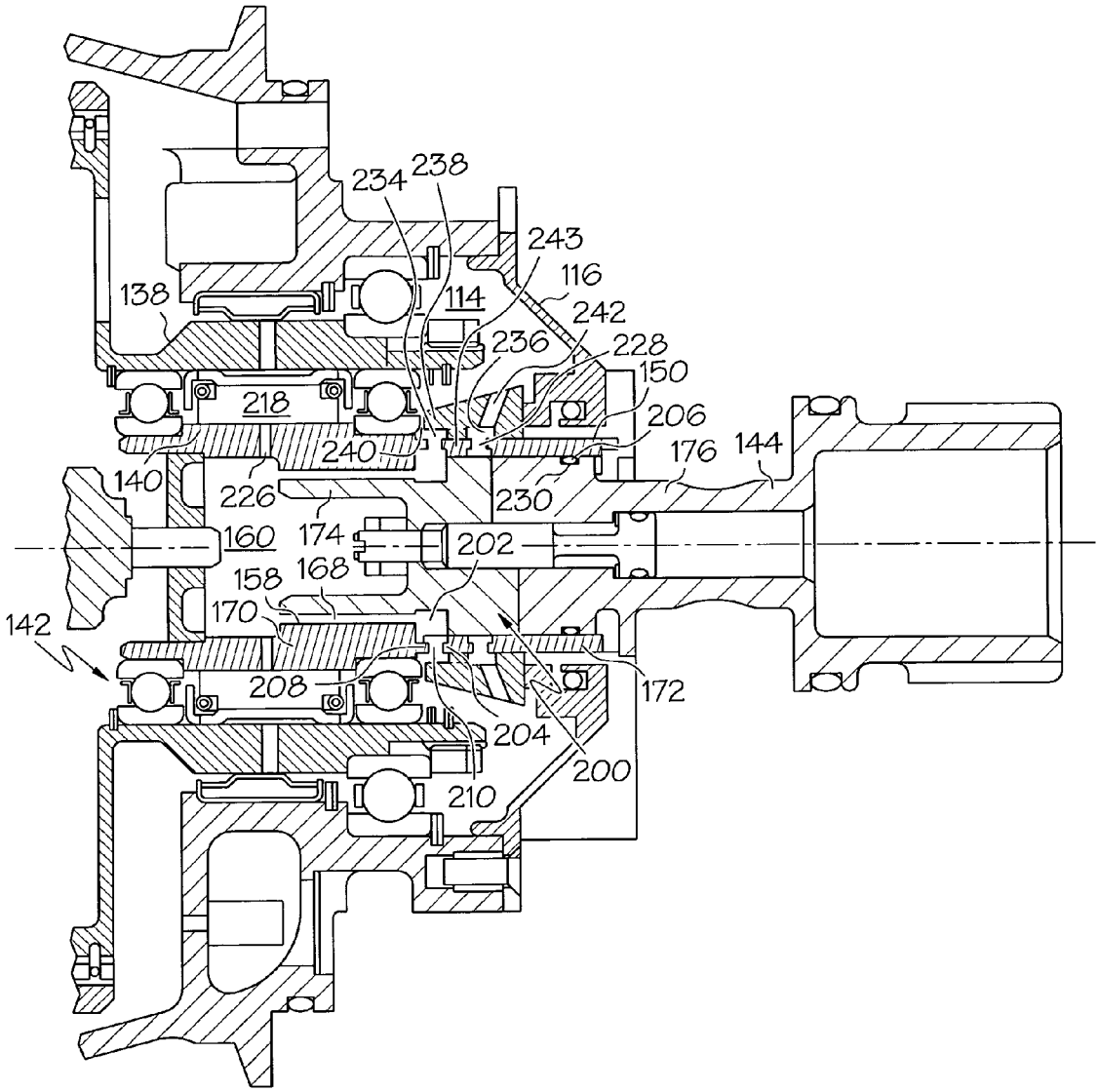
FIG. 12 is a cross-sectional view of still yet another exemplary output shaft air/oil separator system that may be implemented into the air turbine starter of FIG. 1.

In still another alternative embodiment, as shown in FIG. 12, two sets of housing ports 204, 228 are formed in the spline shaft 140 to provide cooling oil to the spline shaft outer surface 150. Each of the ports 204, 228 is formed between the output shaft end 174 and the annular notch 230 and communicates with grooves 234, 236 that are formed in an annular oil cooled rotor component 238 that is mounted to the spline shaft 140. The oil is then drained into the housing cavity 114 via a first oil passage 240 formed between an end of the annular oil cooled rotor component 238 and the inner race 152, via a second oil passage 242 that is formed in the annular oil cooled rotor component 238, or via an axial passage 243, shown in phantom, formed between the annular grooves 234, 236.

Figure 13:
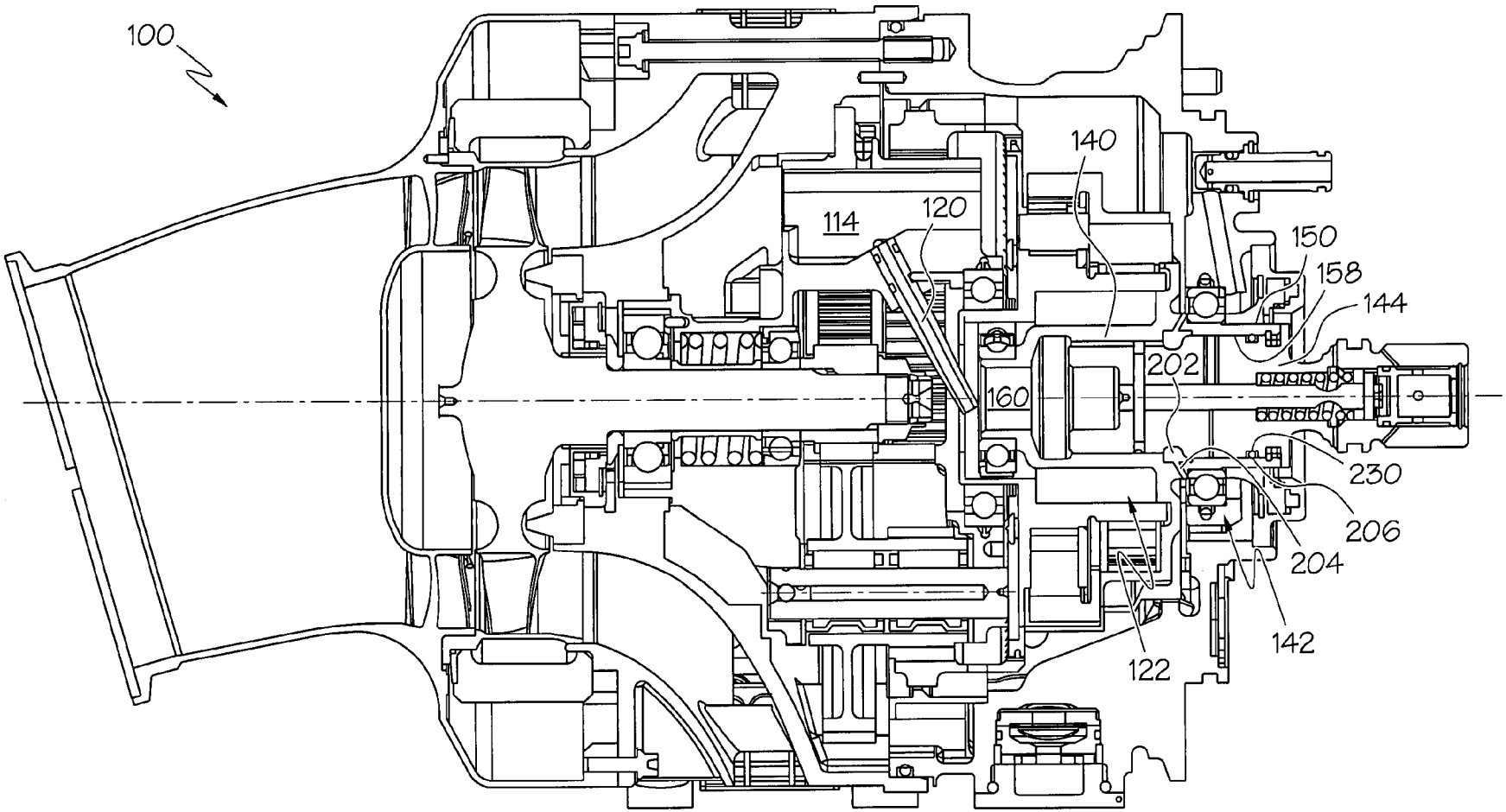
FIG. 13 is a cross-sectional view of another exemplary air turbine starter.

The air/oil separator system 200 may alternatively be implemented into an ATS 100 having a pawl and ratchet-type clutch 122 integrated therein. As shown in FIG. 13, the clutch 122 includes a spline shaft 140 having a cavity 160 formed therein within which an output shaft 144 is partially disposed. Oil is fed to the spline shaft cavity 160 through an oil source passage 120 that also communicates with a housing cavity 114. The spline shaft 140 includes an inner surface 158 and an outer surface 150 to which bearing assemblies 142 are mounted. At least one housing cavity port 204 extends between the spline shaft inner and outer surfaces 158, 150 to provide communication between the spline shaft cavity 160 and the bearing assembly 142.

Similar to previously described embodiments, the spline shaft 140 shown in FIG. 13 includes an annular groove 202 formed in its inner surface 158. The annular groove 202 is located adjacent to and in communication with the housing cavity port 204. It will be appreciated that the annular groove 202 may have any one of numerous cross sections or configurations, such as those shown in FIGS. 3-11. The air/oil separator system 200 may additionally include an annular notch 230 and o-ring 206.

In any case, during operation, the spline shaft 140 and output shaft 144 rotate and a portion of the oil travels through the spline shaft cavity 160, travels through the spline teeth gap 168, into the annular groove 202 and the housing cavity ports 204, and into the housing cavity 114. If the oil travels past the housing cavity ports 204 during non-rotation of the output shaft 144 (e.g. during storage of mounting onto the aircraft), the o-ring 206 will prevent the oil from leaking out of the system.

While the invention has been described with reference to a preferred embodiment, it will be understood by those skilled in the art that various changes may be made and equivalents may be substituted for elements thereof without departing from the scope of the invention. In addition, many modifications may be made to adapt to a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

We claim:

1. An output shaft air/oil separator system, comprising:

an outer housing;

an oil passage disposed in the outer housing and having an outlet port;

a spline shaft having a first end, a second end, an outer surface, and an inner surface defining a cavity extending between the first and second ends, the cavity in communication with the oil passage outlet port;

an output shaft disposed at least partially within the spline shaft cavity, the output shaft having an outer surface including a first section and a second section, the first section spaced apart from the spline shaft inner surface to form a gap therebetween in communication with the spline shaft cavity, and the second section contacting at least a portion of the spline shaft inner surface;

a housing cavity defined by at least a portion of the spline shaft outer surface and the outer housing;

an annular groove formed in the spline shaft outer surface in communication with the spline shaft cavity; and at least one port extending between the spline shaft inner and outer surfaces, the port having an inlet in communication with the annular groove and an outlet in communication with the housing cavity.

2. The system of claim 1, wherein the annular groove has a v-shaped cross section.

3. The system of claim 1, wherein the annular groove has a semicircular cross section.

4. The system of claim 1, wherein the annular groove has a square-shaped cross section.

5. The system of claim 1, wherein an annular notch is formed in the outer surface of the output shaft.

6. The system of claim 5, further comprising an o-ring disposed at least partially within the annular notch.

7. The system of claim 1, the annular groove extends axially along the spline shaft outer surface toward the oil passage.

8. The system of claim 1, further comprising:

a bearing assembly mounted to at least a portion of the spline shaft outer surface;

a bearing cavity defined by the bearing assembly and the spline shaft outer surface; and a second port extending between the spline shaft inner and outer surfaces and having an inlet in communication with the spline shaft cavity and an outlet in communication with the bearing cavity.

9. The system of claim 1, wherein the port is perpendicular to at least one of the spline shaft inner and outer surfaces.

10. The system of claim 1, wherein the port is not perpendicular to at least one of the spline shaft inner and outer surfaces.

11. The system of claim 1, wherein the annular groove has a first section and a second section, the port is disposed therebetween, and the first section has a diameter that is greater than the diameter of the second section.

12. The system of claim 1, wherein the annular groove has a first section and a second section, the port is disposed therebetween, and the first section has a diameter that is less than the diameter of the second section.

13. An air turbine starter, comprising: an outer housing; an oil passage disposed in the outer housing and having an outlet port; a spline shaft having a first end, a second end, an outer surface, and an inner surface defining a cavity extending between the first and second ends, the cavity in communication with the oil passage outlet port; an output shaft disposed at least partially within the spline shaft cavity, the output shaft having an outer surface including a first section and a second section, the first section spaced apart from the spline shaft inner surface to form a gap therebetween in communication with the spline shaft cavity, and the second section contacting at least a portion of the spline shaft inner surface; a bearing assembly mounted to at least a portion of the spline shaft outer surface; a bearing cavity defined by the bearing assembly and the spline shaft outer surface; a housing cavity defined by at least a portion of the spline shaft outer surface and the outer housing; an annular groove formed in the spline shaft outer surface in communication with the spline shaft cavity; a first port extending between the spline shaft inner and outer surfaces and having an inlet in communication with the annular groove and an outlet in communication with the housing cavity; and a second port extending between the spline shaft inner and outer surfaces and having an inlet in communication with the spline shaft cavity and an outlet in communication with the bearing cavity.

14. The air turbine staffer of claim 13, wherein the annular groove has a v-shaped cross section.

15. The air turbine staffer of claim 13, wherein the annular groove has a semicircular cross section.

16. The air turbine starter of claim 13, farther comprising a sprag-type clutch disposed in the housing, wherein the sprag-type clutch includes the spline shaft.

17. The air turbine staffer of claim 13, further comprising a pawl and ratchet-type clutch disposed in the housing, wherein the pawl and ratchet-type clutch includes the spline shaft.

* * * * *

UNITED STATES PATENT AND TRADEMARK OFFICE

CERTIFICATE OF CORRECTION

PATENT NO. : 7,547,185 B2
APPLICATION NO. : 11/207263
DATED : June 16, 2009
INVENTOR(S) : William L. Giesler et al.

It is certified that error appears in the above-identified patent and that said Letters Patent is hereby corrected as shown below:

Column 8, line 27, "farther" should be changed to --further--;
Column 8, line 30, "staffer" should be changed to --starter--.

Signed and Sealed this

Twenty-ninth Day of September, 2009

David J. Kappos

David J. Kappos
*Director of the United States Patent and Trademark Office*